United States Patent [19]

Hamner

[11] 3,945,080

[45] Mar. 23, 1976

[54] BROOM ASSEMBLY

[75] Inventor: William F. Hamner, Raleigh, N.C.

[73] Assignee: Monsanto Company, St. Louis, Mo.

[22] Filed: Nov. 20, 1974

[21] Appl. No.: 525,544

[52] U.S. Cl. ..... 15/187; 15/159 A; 15/172

[51] Int. Cl.[2] ..... A46D 9/02

[58] Field of Search ..... 15/160, 182, 164, 172, 15/176, 186–188, 144 R, 143 R, 106, 159 A

[56] References Cited

UNITED STATES PATENTS

| | | | |
|---|---|---|---|
| 405,297 | 6/1889 | Bailey | 15/188 UX |
| 810,708 | 1/1906 | Brister | 15/235 |
| 2,124,647 | 7/1938 | Bauler | 15/167 R |
| 2,293,905 | 8/1942 | Krebs | 15/229 AP |
| 3,085,272 | 4/1963 | Weichselbaum | 15/187 X |
| 3,312,583 | 4/1967 | Rochlis | 15/159 A |
| 3,507,010 | 4/1970 | Doleman et al. | 425/134 |
| 3,633,974 | 1/1972 | Lewis, Jr. | 15/182 UX |
| 3,755,847 | 9/1973 | Liebscher | 15/187 |

FOREIGN PATENTS OR APPLICATIONS

| | | | |
|---|---|---|---|
| 2,113 | 7/1862 | United Kingdom | 15/188 |

*Primary Examiner*—Peter Feldman
*Attorney, Agent, or Firm*—Russell E. Weinkauf

[57] ABSTRACT

A surface sweeping broom in which the handle is attached to an elongated brush head of circular cross-section. The brush head contains a cylindrical inner core overlaid with a molded thermoplastic brushing surface. The molded brushing surface is comprised of a base or matrix and fingerlike projections which are integrally fused with the matrix and extend vertically from it. In one embodiment, the brush head is provided with a centered bore which extends completely through it. The bore is threaded to secure a handle member which can be inserted at either end of the bore. Thus, when a brushing surface becomes worn, the handle can be reversed. In this manner, all four quadrants of the circular brushing surface can be effectively utilized.

3 Claims, 4 Drawing Figures

BROOM ASSEMBLY

This invention relates to a cleaning device for sweeping surface areas clear of litter and debris. More particularly, the invention is concerned with an improved broom assembly having a unique brush head.

It is an object of this invention to provide a light weight broom of easy maneuverability which is especially suitable for sweeping large outdoor surfaces such as home patios, garages, driveways and sidewalks, and can be used as a rake for indoor shag rugs.

It is another object of this invention to provide a broom having a brushing head of improved durability and wear resistance.

It is a further object of this invention to provide a broom wherein the brushing head contains bristles which are resilient and wherein the resilient bristles maintain their alignment.

It is still another object of this invention to provide a broom having a brush head which is unaffected by household solvents and will not mold or mildew.

It is a further object of this invention to provide a broom having a brush head which is washable and wherein the bristles will not shed.

Yet another object of this invention is to provide a broom having a brush head of circular cross-section and wherein all four quadrants can be placed into brushing use.

The surface sweeping device contemplated by the present invention consists of an elongated brush head of circular cross-section attached to a handle member. The brush head is comprised of an inner cylindrical support core upon which a molded, thermoplastic brushing surface is circumferentially mounted. The molded brushing surface is characterized by a base or matrix from which finger-like projections extend vertically. The projections are integrally fused with the matrix and generally have a length of from about 0.5 to 1.0 inch with the length to width ratio of the projections being usually at least about 10 to 1.

In one embodiment of the invention the matrix of the molded brushing surface consists of parallel strips or stringers with the projections being spaced apart between the parallel strips to which they are integrally fused. In a particularly preferred structure the projections are in clusters with each cluster arising from a cup-shaped supporting base which lies between adjacent parallel strips of the matrix with which it is integrally fused.

The invention will be more readily understood from the following detailed description when read in conjunction with the accompanying drawings wherein.

Figure 1:
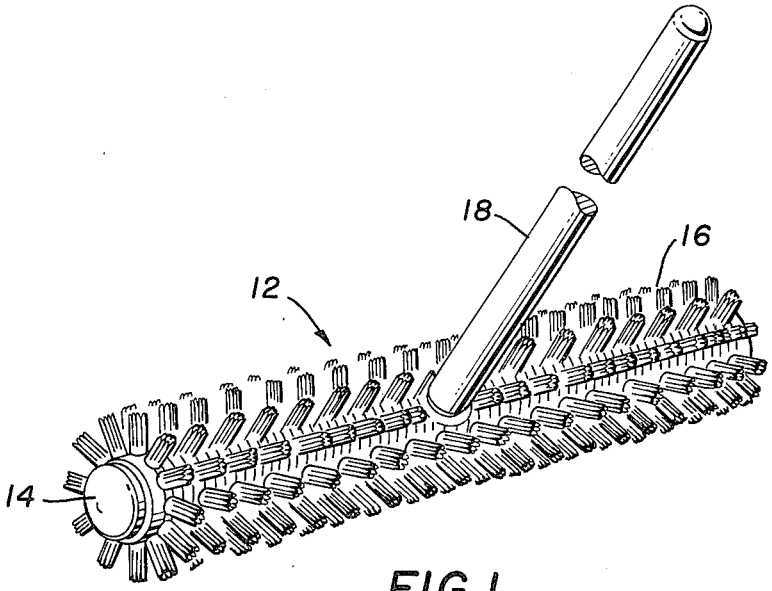
FIG. 1 is a pictorial view of the total broom structure.

With continued reference to the accompanying figures wherein like numerals designate similar parts throughout the various views and with initial attention directed to FIG. 1, reference numeral 12 designates generally an elongated brush head having a round or substantially circular cross-section. The brush head assembly 12 includes a cylindrical inner support core member 14 having a molded, thermoplastic brushing surface 16 circumferentially mounted thereon. A handle member 18 is secured to the brush head assembly 12 at a centrally located position on the brush assembly. The cylindrical support core 14 may be fabricated from any strong, light weight material, e.g., wood, plastic or metal may be used. The brushing surface 16 may consist of any thermoplastic material which can be molded to form the desired structure. Among such materials are polyolefins, such as polyethylene and polypropylene; polyvinylesters, such as polyvinyl acetate, polyamides; polyesters; polyurethane rubbers; natural rubbers and others. A particularly suitable material is low-density polyethylene.

Figure 2:
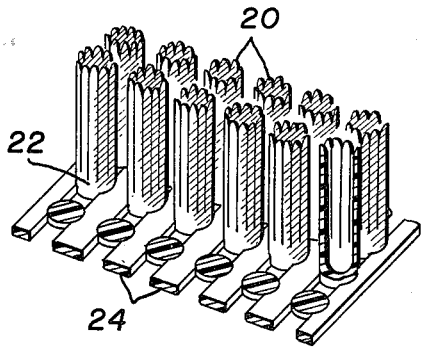
FIG. 2 is a pictorial view of a strip of the molded, thermoplastic brushing surface before mounting on the inner core member of the broom brush head.

Reference is now made to FIG. 2 wherein a molded, thermoplastic brushing surface having a preferred configuration for use in the brush head assembly is illustrated. As shown, clusters of finger-like projections 20 extend vertically from a matrix consisting of spaced apart parallel strips 24. The clusters are spaced apart between and bridge the parallel strips 24, and each cluster is integrally fused with adjacent parallel strips at its cup-shaped base 22. The finger-like projections 20 in each cluster are integral with the cup-shaped supporting base 22 from which they extend upwardly. This and other similar thermoplastic brushing surfaces can be produced by well-known methods for molding thermoplastic materials. A continuous injection molding process such as described in U.S. Pat. Nos. 3,507,010 and 3,590,109 is particularly advantageous and desirable.

Figure 3:
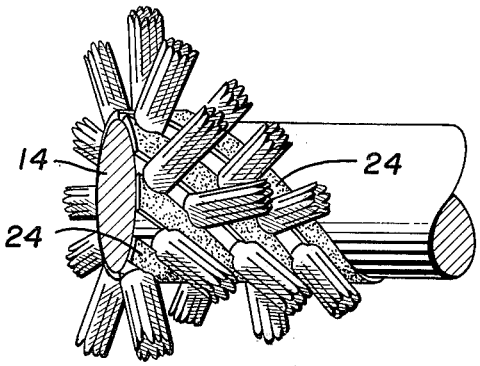
FIG. 3 is a side plan view of a fragment of the brush head illustrating a molded brushing surface which has been mounted on the inner support core by spiral winding.

The molded brushing surface can be circumferentially mounted on the cylindrical support core 14 by any one of a several readily apparent methods. For example, a strip of molded surface corresponding in dimensions to the cylindrical core member can be merely wrapped around the core and the opposing ends joined by heat sealing, stapling or by stitching together. When mounted in this fashion, referred to as straight winding, the clusters 20 are aligned in parallel rows around the circumference of the supporting core 14. In another method, a relatively narrow length of the molded thermoplastic is spirally wound about core 14 in which case the clusters of projections will have a spiral arrangement around the circumference of the supporting core such as is shown in FIG. 3. The advantage is a greater density of projections per unit area. Melt bonding or adhesive bonding may be employed to effect adherence of the molded plastic to the cylindrical core.

Figure 4:
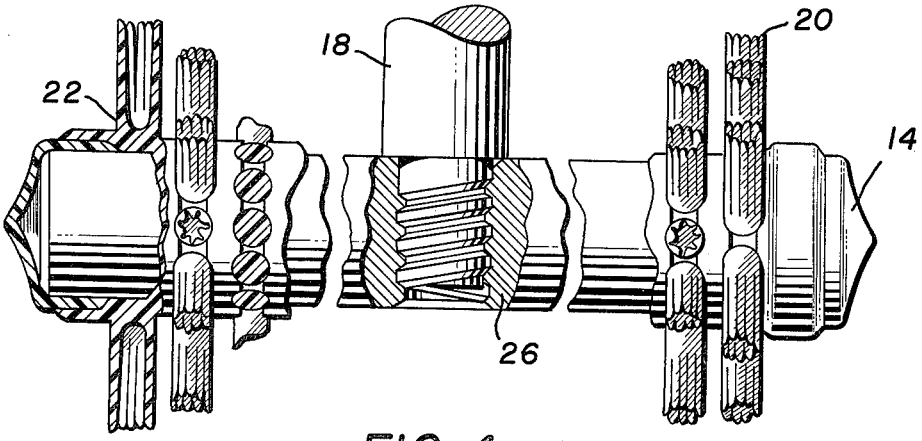
FIG. 4 is a partially broken side view of the brush head showing details on the attachment of the handle member in the bore which is centrally disposed in and traverses the width of the broom brush head.

A number of methods may be used for connecting the handle member to the brush head assembly. For example, the handle could be connected to a length of metal wire having two prongs with one prong being connected to one end of the core and the other prong to the opposite end of the core to give an arrangement such as is used in a paint roller. However, a particularly preferred manner of attachment is to drill a hole in the center of the brush head assembly which is then threaded for receiving a threaded end of the handle member. Preferably, the threaded bore is extended entirely through the brush head so that the handle can be received and secured at either end of the bore. This permits reversing the position of the handle on the brush head so that all four quadrants of the circular brushing surface can be used. Thus, when wear takes place the position of the handle can be switched to effect sweeping action on an unworn surface of the brush head. This embodiment is illustrated in FIG. 4 of the accompanying drawing wherein the numeral 26 designates the threaded bore for receiving and securing handle member 18.

Because of the round configuration of the brush head, sweeping of walls, under chairs and at other angles is made much less difficult than is the case with conventional brooms. Moreover, the sweeping device as herein described contains much less dead weight than do standard brooms used for sweeping large outdoor surfaces, such as home patios, garages, driveways and sidewalks. As a consequence, the broom has greater maneuverability. In addition the unique molded, thermoplastic brushing surface has greater durability and resistance to wear than the brushing means used in conventional brooms. Also, the bristles are resilient and maintain their original alignment indefinitely. Further advantages are that the brush head is washable and the bristles cannot shed. In addition, the brushing surface is unaffected by household solvents and will not mildew.

The invention may be embodied in other specific forms without departing from the spirit or essential characteristics thereof. The present embodiments are therefore to be considered as illustrative only and not restrictive, the scope of the invention being indicated by the appended claims rather than by the foregoing description and all changes which come within the meaning and range of equivalency of the claims are therefore intended to be embraced thereby.

I claim:

1. A broom assembly for sweeping litter from large surface areas which comprises in combination:

a. a handle member;

b. an elongated brush head of circular cross-section characterized by:

i. an inner cylindrical support core;

ii. a molded, thermoplastic, brushing surface circumferentially mounted on said support core;

iii. a centrally disposed bore which extends through the entire width of the brush head, with the bore being adapted for receiving and engaging said handle member at either end of the bore;

c. said molded, thermoplastic, brushing surface being characterized by:

i. a matrix consisting of spaced apart parallel strips; and ii. clusters of vertically extending projections which are spaced apart between said parallel strips and wherein each cluster of projections arises from a cup-shaped supporting base which is integrally fused with adjacent parallel strips of said matrix to form a bridge therebetween.

2. The broom assembly in accordance with claim 1, wherein said thermoplastic brushing surface is composed of low-density polyethylene.

3. The broom assembly in accordance with claim 1, wherein said projections have a length of from about 0.5 to 1.0 inch and a length to width ratio of at least 10 to 1.

* * * * *